US005152560A

United States Patent [19]

Heydendahl

[11] Patent Number: 5,152,560

[45] Date of Patent: Oct. 6, 1992

[54] LOCKING DEVICE FOR DOORS

[76] Inventor: Mark S. Heydendahl, 3049 W. Coolidge, No. 3, Anaheim, Calif. 92801

[21] Appl. No.: 755,035

[22] Filed: Sep. 4, 1991

[51] Int. Cl.[5] ..... E05B 47/00

[52] U.S. Cl. ..... 292/131; 292/DIG. 44

[58] Field of Search ..... 292/122, 341.19, DIG. 69, 292/DIG. 36, 201, DIG. 44, 131

[56] References Cited

U.S. PATENT DOCUMENTS 2,660,765 12/1953 Carlson ..... 292/DIG. 36 X
2,800,348 7/1957 Parsley ..... 292/DIG. 36 X
2,801,872 8/1957 Jewell ..... 292/341.17
3,338,612 8/1967 Howard ..... 292/DIG. 44 X
3,377,092 4/1968 Rohman ..... 292/201
3,838,877 10/1974 Hanson ..... 292/DIG. 36 X
4,305,611 12/1981 Robins ..... 292/341.19

*Primary Examiner*—Richard E. Moore
*Attorney, Agent, or Firm*—James G. O'Neill

[57] ABSTRACT

A solenoid operated locking means is mounted interiorly of a garage door, so as to provide additional security. The locking means includes a link and bar arrangement connected to the solenoid for opening a normally closed hasp that cooperates with the bar of a locking staple fixed to the top of the garage door. Additionally, if needed, the locking bar of the staple may be manually opened by removing a dowel pin held in position in the staple by means of a frangible element that may be easily broken and replaced, as desired.

16 Claims, 3 Drawing Sheets

LOCKING DEVICE FOR DOORS

BACKGROUND OF THE INVENTION

1. Field of the Invention

This invention relates generally to locking devices and more particularly to an improved locking device for mounting interiorly of a door, and which may be electrically or manually operated.

2. Description of Related Art

Most closure means or doors have one or more locking or security means to insure that the closure means are not opened by unwanted persons seeking access to a home, garage, room or other area where access is to be restricted. Many of these known locking or securing means are mounted in or around a closure means or door and may be electrically operated. However, these known devices do not always provide sufficient security in high crime areas, or in locations where valuable goods may be stored. Therefore, additional locks or security means must be added to provide sufficient safety and security, for a homeowner, business person or driver of a vehicle.

One such prior art locking device is shown in U.S. Pat. No. 1,995,889, which discloses a safety device for automatically locking the doors of a vehicle, when it is in motion. The locking device includes a solenoid actuated pair of latches that are pivotally mounted on the frame of a vehicle between two doors of the vehicle, with spring means normally biasing the latches toward each other. Upon actuation of the solenoid actuator, as when the vehicle ignition switch is engaged, the latches are forced into locking engagement with the two doors between which they are mounted. This patent, however, fails to disclose a solenoid actuated locking device which may be easily mounted on the interior of a door, without the use of special tools, for added security, after a door or the like has been installed.

Another prior art device is shown in U.S. Pat. No. 2,607,586, which discloses a manual or solenoid operated locking means that cooperates with, and is installed with, an electrically operated garage door. This locking means is limited to use with garage doors and electrically operated means for opening and closing the same, as specifically disclosed therein, and can not easily be adapted for use on or with other garage doors or closure means.

U.S. Pat. No. 2,470,285, shows a locking and release mechanism for a garage or other door which may be operated by means remote from the door. An electromagnet or solenoid operator is actuated to operate a series of levers, rods and wires to thereby open a pair of latches holding both sides of a tiltable door, or the top and bottom portions of one of a pair of swinging doors, in the locked position.

U.S. Pat. No. 2,800,348, shows an electrically operated lock for an overhead garage door, including a rotating disc having a latch receiving notch and a locking detent. The locking detent cooperates with a toggle locking arm that is normally biased to the locking position to prevent rotation of the rotating disc to thereby capture a pin element of a latch in the receiving notch to prevent opening of a door on which the latch is mounted. Upon actuation, a solenoid pulls or moves the toggle away from cooperation with the locking detent to thereby allow the disc to be rotated to release the pin element of the latch from the latch receiving notch and allow the door to which the latch is mounted to be opened. This device, however, requires exact alignment of the latch and the latch receiving notch, or the rotating disc and latching means will not operate properly, or at all.

U.S. Pat. No. 3,199,153, shows a garage door opener which is automatically operated upon the approach of an automobile. The device includes a spring biased latch which cooperates with a catch mounted on a garage door, adjacent its lower edge, to hold and lock the door in the closed position. The latch is actuated or pivoted, against the spring bias, to release the catch and allow the garage door to open, by an air, or other fluid operated piston member, which presses against the base of the latch and rotates it around its pivot point. This device, however fails to add any additional security, and is merely used for convenient opening of the garage door by the weight of an approaching vehicle.

U.S. Pat. No. 3,996,591, shows an added security device for a garage door, which includes a pin movable longitudinally in a bushing between a door frame and a movable door by an electric motor linked to the pin. Careful alignment of the openings from the bushings with the openings in the frame of the door are required, or the pins will not move into the openings and lock the door.

U.S. Pat. No. 4,170,374, shows a closure latch for use on delivery trucks incorporating a remotely operated electrically powered device and a separate manually operable mechanism for unlatching the latch. This device could not be easily modified for use with a tiltable or other garage door.

While the foregoing mentioned prior art devices provide some limited improvements in the locking and security art, there remains the need in the art for an easy to use, low-cost locking device that may be installed on or used with currently existing doors, or on new doors, and which, although it may be used alone, will add to any existing or other locking means that my be used on or with such doors. The improved and simplified locking device of the present invention allows a person to easily add additional security to a garage or other door in such a manner that any party not familiar with the door or added locking device will be unable to determine even if such a device has been added. The only way to determine if a locking device of the present invention has been installed on a door is for a person to actually attempt to forcibly move or open the door. None of the prior art devices discussed above allow such additional security, nor do they lend themselves to be easily added to a door in the manner, or with the ease and simplicity of the present invention.

SUMMARY OF THE INVENTION

Accordingly, it is a general object of the present invention to provide an improved locking means for a door. It is a particular object of the present invention to provide a locking device for garage doors. It is a still more particular object of the present invention to provide a simple to install locking device that does not require exact alignment of its various elements, and which may be used in conjunction with other locking means on a door. It is a still further object of the present invention to provide an electrically actuated locking means for a door which includes adjusting and safety release means to allow it to be easily adjusted over time and manually opened in an emergency, even if no electricity is available.

In accordance with one aspect of the invention, there is provided a door locking means comprising a solenoid actuated hasp that is normally biased by gravity to the closed position where it contacts, and holds in place, a staple or closure means that is attached to the top of a door. The hasp is movable to the open position by actuating the solenoid to thereby allow the door to be opened.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, wherein:

DESCRIPTION OF THE PREFERRED EMBODIMENTS

Figure 1:
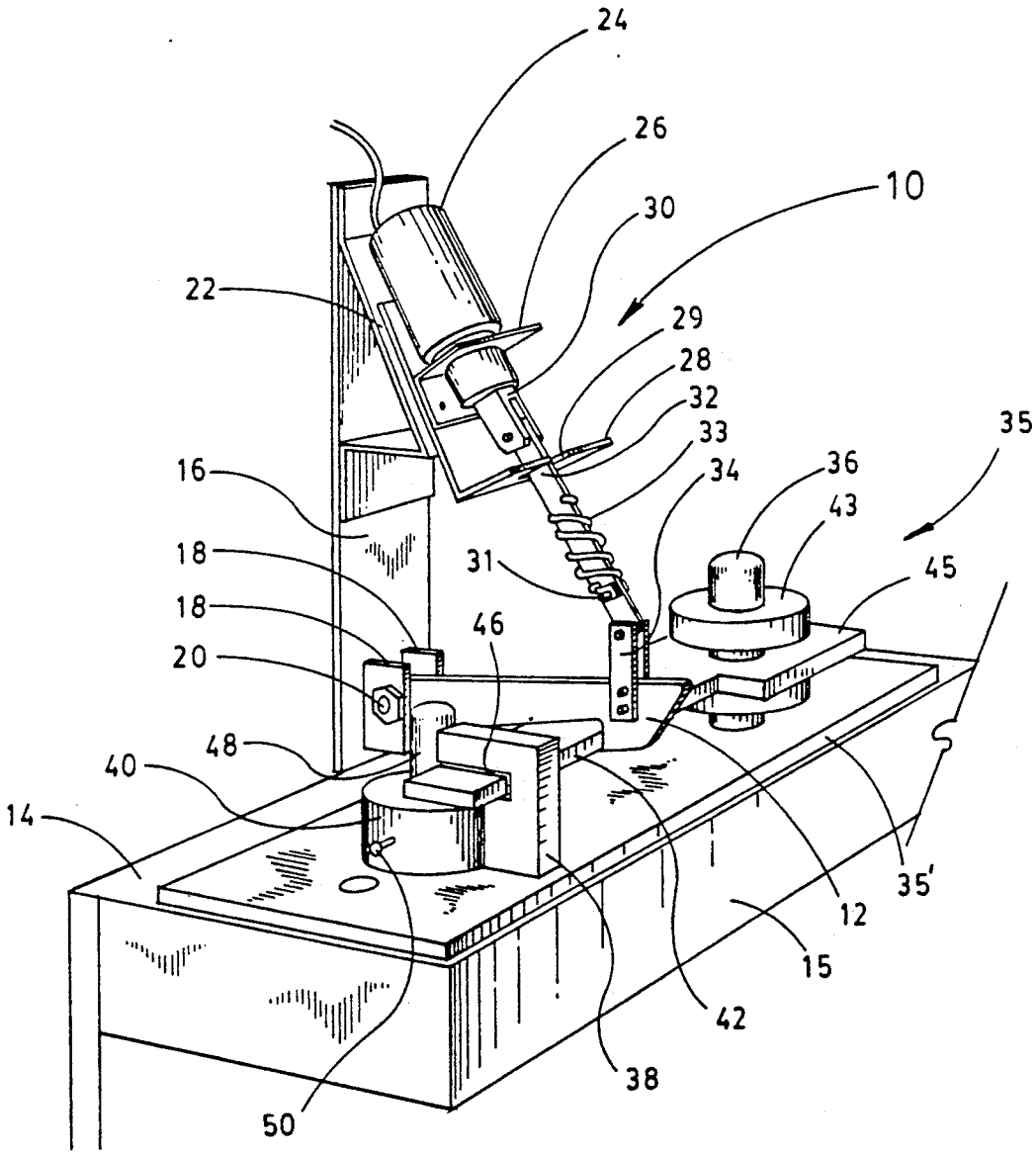
FIG. 1 is a perspective view of the preferred locking means of the present invention mounted on the top of a door, with the latching means in the locked position.

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide for an improved locking means, indicated generally by the numeral 10 in the attached drawings.

Although the elements of locking means 10 may be made from any type of strong material, the elements thereof are preferably made from metals to provide sufficient strength. Furthermore, although the locking means of the present invention may be adapted for use with any size and type of closure means or door, the locking means 10 is preferably used with, and is, therefore, described hereinafter with relation to a garage door of the tilt-up type. The locking means 10 includes a movable hasp or latch 12, pivotally or rotatably mounted, in any convenient manner, above a garage door 14, as by means of a holding plate 16, having a pair of flanges 18, formed integrally therewith or fixed thereto, on the lower end thereof, adjacent top 15 of the door 14. The flanges 18 and hasp 12 include aligned openings through which a pivot means, such as a bolt 20 may pass and be secured in place to allow the hasp 12 to pivot or rotate thereon, in a known manner. The holding plate 16 is preferably secured to the header found above the door 14, in any convenient manner, and includes an angled bracket 22, fixed thereto at the upper end thereof, away from the top 15 of the door 14. A solenoid 24, is mounted on the angled bracket 22, by means of a rear support 26 and a front support 28, which supports are adjustably mounted to the angled bracket, in any convenient manner, as is known to those skilled in the art. The solenoid includes an armature or plunger 30 of the pull-in type, fixed to an attaching bar or rod 32, which is in turn attached to a linking means 34, attached to hasp 12. The bar 32 passes through a slot 29 formed in the front support 28, which front support 28, limits outward or downward movement of the armature 30. The support 28 also acts to stop movement of and compress a spring 33 mounted around the bar 32, which spring has its other end normally resting against a stop means 31, such as a bolt and nut arrangement, passing through and secured to the bar 32. Thus, it can be seen that front support 28, slot 29, and spring 33 act to both limit, and start the movement of the armature 30, as explained more fully below.

A staple, or other holding portion 35 of the locking means 10, cooperates with the hasp 12 to hold and lock the door 14 in the closed or locked position. The staple 35 includes a metal base or mounting plate 35', secured in any convenient manner, as by bolts or screws, to the top 15 of the garage door 14. The staple 35 is thus formed from the mounting plate 35' and a plurality of upwardly extending portions (i.e, pointing toward the hasp and solenoid actuator), such as a cylindrical post 36, a substantially rectangular bar retainer 38, and an annular supporting member 40, secured to, or integrally formed with the mounting plate 35'. Additionally, the staple 35 includes a substantially rectangular holding bar 42, rotatably mounted on the cylindrical post 36, and fixedly held thereon between a pair of annular collars 43, 44, which are in turn fixed or secured to post 36, as by set screws or the like.

Figure 4:
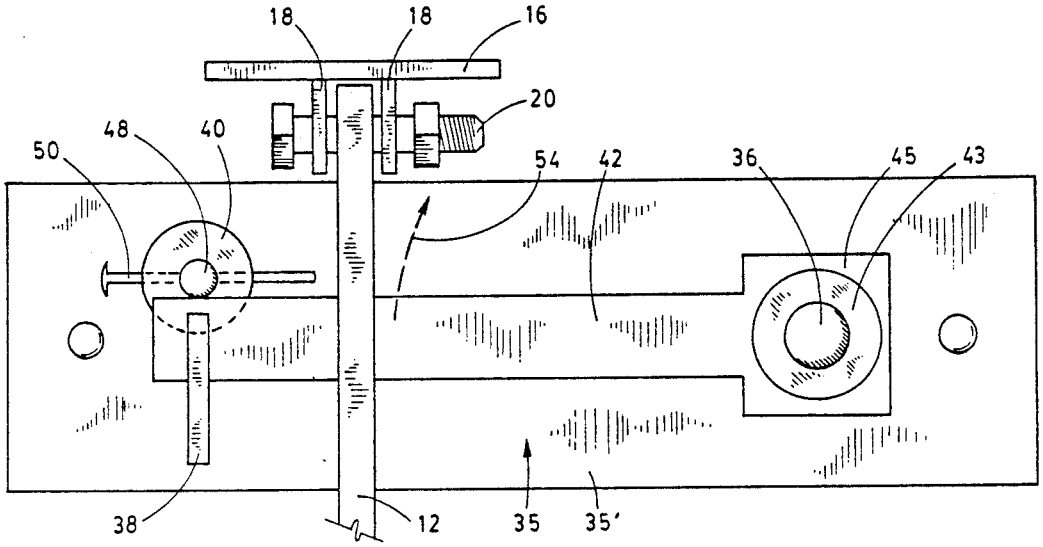
FIG. 4 is a partial top view of the locking means of FIG. 1.
Figure 5:
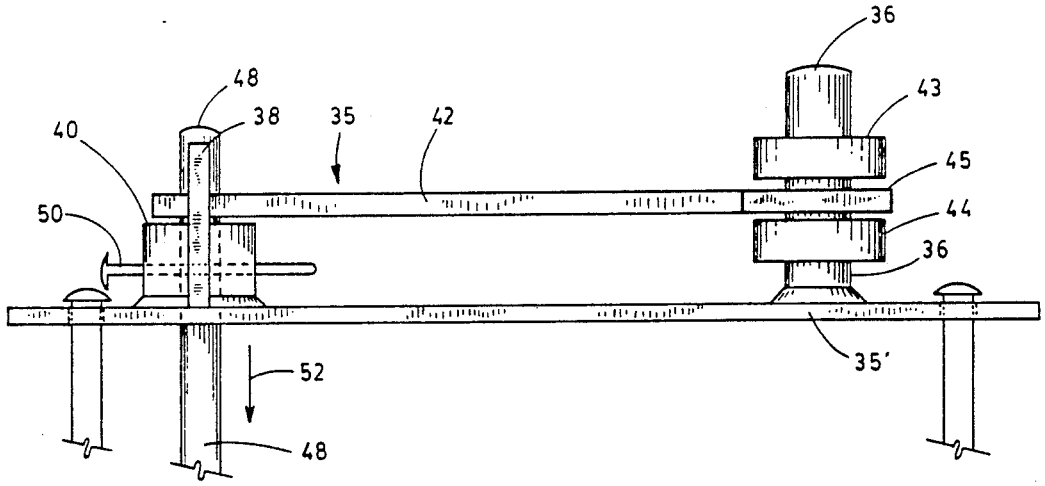
FIG. 5 is a partial side view of the locking means of FIG. 1.

As shown in FIGS. 1, 4 and 5, a first end of bar 42 includes on opening which is mounted to the post 36. This first end may also include an enlarged or strengthened area or portion 45 held between the annular collars 43, 44. The other or second end of the bar 42 is normally held in a slot 46 formed in bar retainer 38, or may be rotated out of slot 46, as explained in more detail below.

Figure 2:
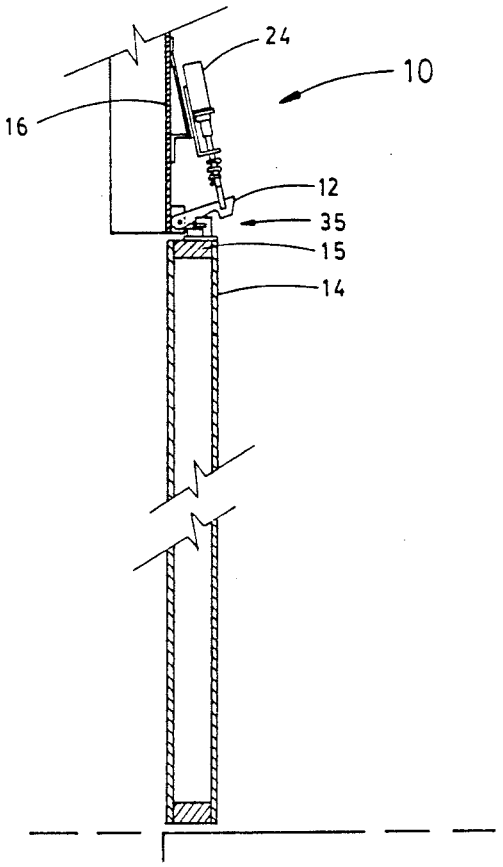
FIG. 2 is a side elevational view of a garage door, partially in cross-section, having the locking means of the present invention mounted thereon, with the latching means in the open position.
Figure 3:
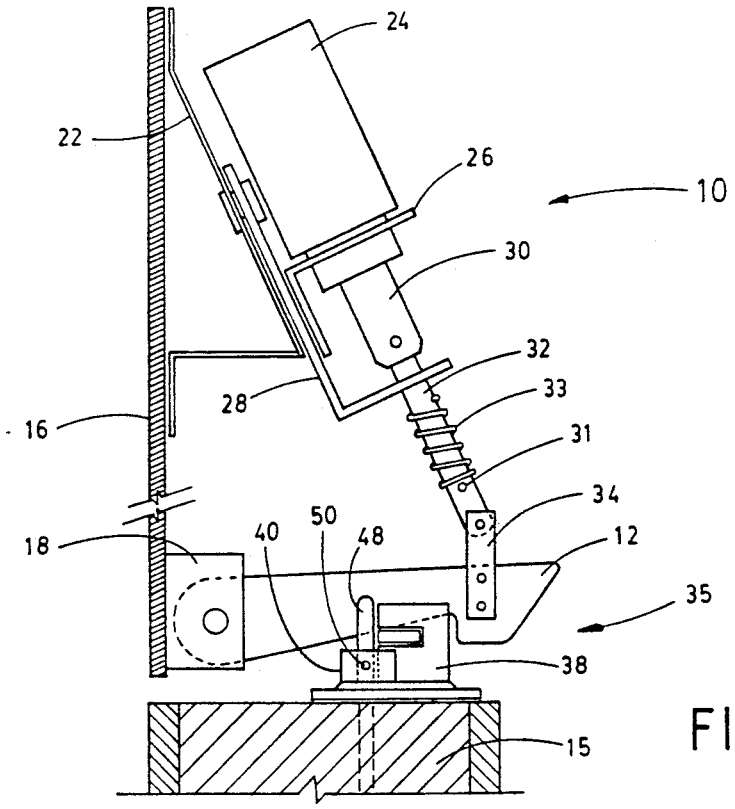
FIG. 3 is a side elevational view of the locking means of FIG. 1.

As shown most clearly in FIGS. 1 and 3, the hasp or latch 12 is normally biased downwardly, by gravity, so as to cooperate with bar 42 and hold or lock the staple 35 and, therefore, the garage door 14 to which it is attached, in the closed or locked position. When the garage door is to be opened or unlocked, the solenoid 24 is actuated, in a manner known to those skilled in the art, to pull the armature 30 into the solenoid 24. The upward movement of the armature 30 pulls up the bar 32, against the compression of spring 33, after spring 33 moves into contact with the front support 28. This movement of bar 32, pulls up the linking means 34, to thereby raise the hasp 12 to the open position, as shown more clearly in FIG. 2. In this raised or unlocked position of hasp 12, the bar 42 of staple 35 will clear or pass the hasp 12, thus allowing the door 14 to be tilted upwardly to the open position. When the door 14 is again lowered to the closed position, the hasp 12 will be automatically lowered by gravity, as well as the force from spring 33. Although the spring 33 does not have to be very heavy or strong, this spring is necessary to aid gravity in overcoming any "static hold" or "surface tension", caused by residual magnetism between the solenoid 24 and withdrawn armature 30, and move the hasp 12 to the lowered or locked position.

In an emergency, or if for some reason the solenoid 24 will not operate to raise the hasp 12 when it is in the locked position, the present invention includes a manual release means, comprising a removable dowel pin 48, held in the annular supporting member 40 of staple 35 and a frangible element or member 50, which passes through and is normally held within aligned openings passing through the annular supporting member 40 and the dowel pin 48. The frangible member 50 may be made from any available material which is easily broken, such as lead, plastic, solder, soft wire, or the like. Therefore, when a person pulls or pushes, preferably downward, on the dowel pin 48 in the direction of arrow 52, shown in FIG. 5, the force applied to the dowel pin 48 breaks or shears the frangible member 50 and allows the dowel pin 48 to be pulled out or removed from the annular supporting member 40. With the dowel pin 48 removed, the bar 42 may be manually rotated about the post 36, out of the slot 46 and past the annular supporting member 40, in the direction of broken arrow 54, shown in FIG. 4. This movement of the bar 42, out of the slot 46 and out of contact with the hasp 12, then allows the door 14 to be tilted upwardly to the opened position. After the emergency passes, or the solenoid 24 is again operable, the bar 42 is rotated back into the locking position in slot 46, and the dowel pin 48 may be easily reinserted into the annular holding member 40. A new frangible element may then be inserted in the aligned openings to keep the dowel pin and bar 42 locked in place until a further need to remove the dowel pin arises.

In accordance with an important aspect of the present invention, the locking means 10 may be easily mounted in almost any position over and on the top of an existing closure means such as a garage door, interiorly of the garage. The hasp 12 and bar 42 are both made so as to be of a size allowing for a large range of movement and or alignment thereof when installing the same to a door, while at the same time providing positive locking in use, after installation. Further features of the locking device disclosed herein allow it to be easily adjusted to correctly fit most, if not all doors, and to accommodate any changes in the door and/or frame alignment, as the elements of the locking device wear, and the door and frame age or weather.

As will be obvious to one skilled in the art, the locking means, when correctly installed, will not be seen from the outside, thereby adding additional security to the door. Therefore, anyone who might try to force open a garage door having a locking device of the present invention mounted thereon and locked in place, even after disabling other external locking devices on the door, would still be thwarted, in their attempt to open the locked door, by the locking means of the present invention. If desired or required, other plates or blocking means could be added near the top 15 of the garage door, or fixed to the bottom of the holding plate 16. These blocking means or plates would prevent any one from seeing through, and/or block any attempted insertion of tools or the like into any cracks or spaces, formed between the door frame and the top of the garage door, if someone attempts to force open the door with the locking device 10 in the locked position.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What I claim is:

1. A locking device for closure means movable between closed and opened positions, comprising in combination:

a holding plate mounted adjacent said closure means;

a hasp pivotally carried in said holding plate for movement between locked and unlocked positions;

a solenoid actuator carried by said holding plate and attached to said hasp to pivot said hasp from said locked to said unlocked position upon actuation of said solenoid; and a staple means secured to said closure means in a position adjacent said hasp, when said closure means is in the closed position; said staple means including a movable bar which cooperates with said hasp, when said hasp is in the locked position and said closure means is in the closed position, to lock said closure means from further movement.

2. The locking device of claim 1, further including a dowel pin releasably mounted in said staple where it cooperates with said movable bar to prevent said bar from movement; said movable bar being capable of rotation to an unlocked position, away from cooperation with said hasp, when said dowel pin is removed from said staple.

3. The locking device of claim 2 wherein said dowel pin is held in said staple by a frangible element inserted in and held in aligned openings formed in said staple and said dowel pin.

4. The locking device of claim 3 wherein said frangible element is made from a material which is selected from a group of easily broken materials, such as lead, plastic, solder, soft wire, and the like.

5. The locking device of claim 1 wherein said solenoid includes an armature which is of the pull-in type, and said hasp is attached to said armature by means of a bar and link means.

6. The locking device of claim 5 wherein said bar is connected between said armature and said link means, and a spring is mounted on said bar, between a stop means formed to said bar and a support for said solenoid; said spring acting to aid in withdrawing said armature from said solenoid.

7. The locking device of claim 6, further including a dowel pin releasably mounted in said staple where it cooperates with said movable bar to prevent said bar from movement; said movable bar being capable of rotation to an unlocked position, away from cooperation with said hasp, when said dowel pin is removed from said staple.

8. The locking device of claim 7 wherein said dowel pin is held in said staple by a frangible element inserted in and held in aligned openings formed in said staple and said dowel pin.

9. The locking device of claim 8 wherein said frangible element is made from a material which is selected from a group of easily broken materials, such as lead, plastic, solder, soft wire, and the like.

10. A locking device for a garage door of the tilt-up type; said garage door having a top and a bottom and movable from an opened to a closed position in a frame; said locking device comprising, in combination:

a holding plate secured to a header forming a portion of said frame adjacent the top of said garage door when said garage door is in the closed position;

said holding plate including means for adjustably mounting a solenoid actuator, and pivotally mounting a hasp thereon;

said hasp being connected to an armature of said solenoid by a bar and link means, whereby upon actuation of said solenoid, said hasp will be moved from a locked position to an unlocked position;

staple means secured to the top of said garage door in a position where it will cooperate with said hasp when said garage door is in said closed position and said hasp is in said locked position, to thereby lock said garage door in said closed position;

a dowel pin releasably mounted in an annular supporting member formed in said staple; said dowel pin normally cooperating with a movable bar secured to said staple to prevent said bar from movement; said movable bar being rotated to an unlocked position, away from cooperation with said hasp, when said dowel pin is removed from said staple, to thereby allow said garage door to be opened with said hasp in the locked position.

11. The locking device of claim 10 wherein said dowel pin is held in said annular support member by a frangible element inserted in and held in aligned openings formed in said annular supporting member and said dowel pin.

12. The locking device of claim 11 wherein said frangible element is made from a material which is selected from a group of easily broken materials, such as lead, plastic, solder, soft wire, and the like..

13. A locking device for a garage door of the tilt-up type; said garage door having a to and a bottom and movable from an opened to a closed position in a frame; said locking device comprising, in combination:

a holding plate secured to a header forming a portion of said frame adjacent the top of said garage door when said garage door is in the closed position;

said holding plate including an angled bracket fixed thereto, and means for adjustably mounting a solenoid actuator to said angled bracket, and pivotally mounting a hasp to said holding plate;

said hasp being connected to an armature of said solenoid by a bar and link means, whereby upon actuation of said solenoid, said armature will be pulled into said solenoid and said hasp will be raised form a locked position to an unlocked position;

a staple means secured to the top of said garage door in a position where it will cooperate with said hasp when said garage door is in said closed position and said hasp is in said locked position, to thereby lock said garage door in said closed position; said staple means including a movable bar which cooperates with said hasp, when said hasp is in the locked position and said garage door is in the closed position, to lock said garage door; and a release means including a dowel pin releasably mounted in an annular supporting member formed in said staple; said dowel pin normally cooperating with said movable bar of said staple to prevent said bar from movement; said movable bar being rotated to an unlocked position, away from cooperation with said hasp, when said dowel pin is removed from said annular supporting member to thereby allow said garage door to be opened with said hasp in the locked position; and said dowel pin being held in said annular supporting member by a frangible element made from a material which is easily broken inserted in and held in aligned opening formed in said dowel pin and said annular supporting member.

14. A locking device for a garage door of the tilt-up type; said garage door having a top and a bottom and movable from an opened to a closed position in a frame; said locking device comprising, in combination:

a holding plate secured to a header forming a portion of said frame adjacent the top of said garage door when said garage door is in the closed position;

said holding plate including means for adjustably mounting a solenoid actuator, and pivotally mounting a hasp thereon;

said hasp being connected to an armature of said solenoid by a bar and link means, whereby upon actuation of said solenoid, said hasp will be moved from a locked position to an unlocked position;

said armature being of the pull-in type, and said bar being connected between said armature and said link means; said bar including a spring mounted thereon, between a stop means formed to said bar and a front support for said solenoid; said spring action to aid in withdrawing said armature from said solenoid, after said solenoid has been actuated to pull said armature into said solenoid and compress said spring against said front support; and staple means secured to the top of said garage door in a position where it will cooperate with said hasp when said garage door is in said closed position and said hasp is in said locked position, to thereby lock said garage door in said closed position.

15. The locking device of claim 14 wherein said solenoid is adjustably mounted on an angled bracket fixed to said holding plate between said front support and a rear support.

16. The locking device of claim 15 wherein said front support includes a slot formed therein through which said bar connecting said armature and said link means passes; and said front support limits the outward movement of said armature from said solenoid.

* * * * *